US005940896A

United States Patent [19]

Berring

[11] Patent Number: 5,940,896

[45] Date of Patent: Aug. 24, 1999

[54] SANITARY TOILET SEAT APPARATUS

[76] Inventor: Jeffrey J Berring, 250 Lakengren Dr., Eaton, Ohio 45320

[21] Appl. No.: 09/067,181

[22] Filed: Apr. 27, 1998

Related U.S. Application Data

[63] Continuation-in-part of application No. 29/067,232, Feb. 28, 1997, Pat. No. Des. 393,899.

[51] Int. Cl.[6] ..... A47K 13/10

[52] U.S. Cl. ..... 4/241; 4/237; 4/246.1

[58] Field of Search ..... 4/237, 246.3, 246.1, 4/241, 248, 234

[56] References Cited

U.S. PATENT DOCUMENTS

| | | | |
|---|---|---|---|
| 2,042,276 | 5/1936 | Revers | 4/246.3 |
| 2,723,400 | 11/1955 | Wilson | 4/246.1 |
| 4,578,830 | 4/1986 | Chuang | 4/246.3 |
| 5,461,733 | 10/1995 | McKee | 4/246.1 |
| 5,754,985 | 5/1998 | Dias | 4/241 X |

*Primary Examiner*—Henry J. Recla
*Assistant Examiner*—Kathleen J. Prunner

[57] ABSTRACT

A new sanitary toilet seat apparatus for permitting a user to raise and lower a toilet seat without having to touch the toilet seat directly. The inventive device includes a toilet seat which is pivotally couplable to a toilet. At least one counterweight member is coupled to the back end of the toilet seat. A handle member is pivotally coupled to the counterweight member such that the upper end of the handle member upwardly extends from the counterweight member.

7 Claims, 5 Drawing Sheets

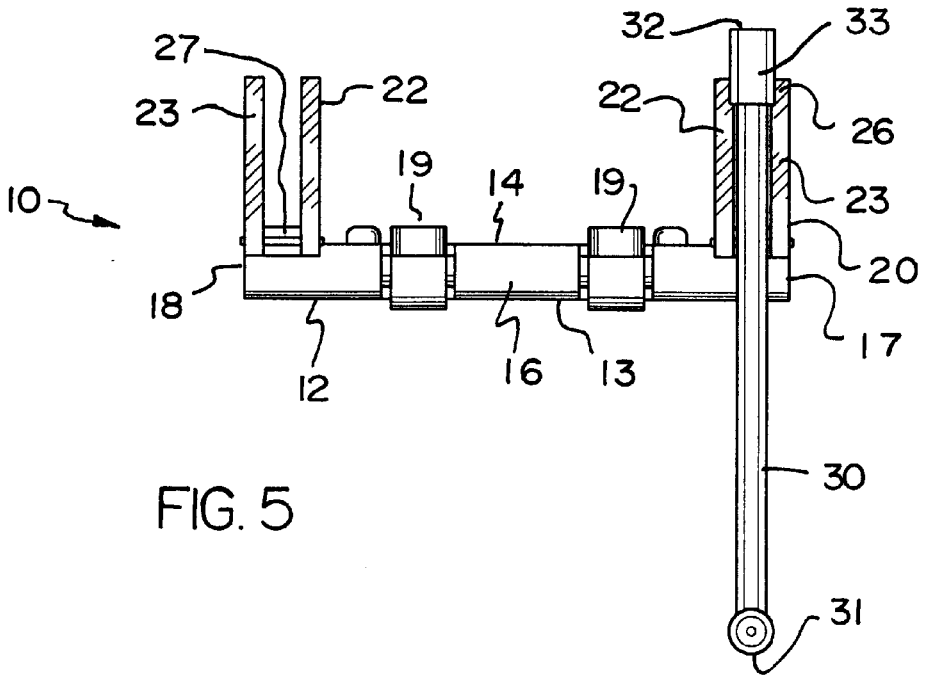
FIG. 5
FIG. 6
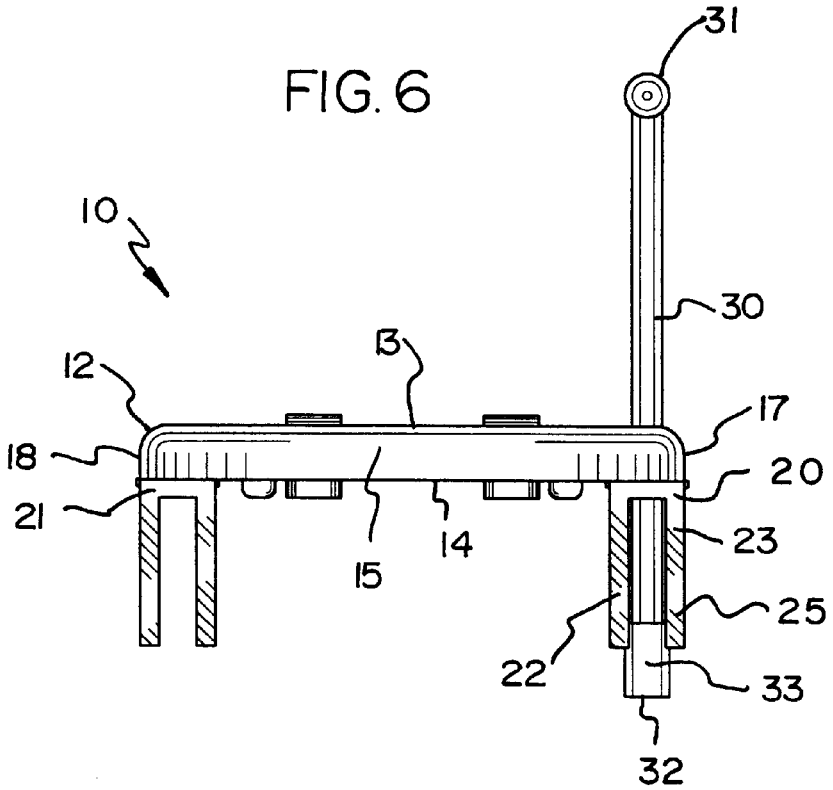

SANITARY TOILET SEAT APPARATUS

CROSS REFERENCE TO RELATED APPLICATION

This application is a continuation-in-part of my prior design patent application Ser. No. 29/067,232, filed Feb. 28, 1997, now U.S. Pat. No. D 393,899.

BACKGROUND OF THE INVENTION

1. Field of the Invention

The present invention relates to toilet seat lifting devices and more particularly pertains to a new sanitary toilet seat apparatus for permitting a user to raise and lower a toilet seat without having to touch the toilet seat directly.

2. Description of the Prior Art

The use of toilet seat lifting devices is known in the prior art. More specifically, toilet seat lifting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet seat lifting devices include U.S. Pat. No. 5,437,063; U.S. Pat. No. 5,020,165; U.S. Pat. No. 4,910,810; U.S. Pat. No. Des. 351,550; U.S. Pat. No. 5,394,570; and U.S. Pat. No. 5,435,017.

While these devices fulfill their respective, particular objectives and requirements, the aforementioned patents do not disclose a new sanitary toilet seat apparatus. The inventive device includes a toilet seat which is pivotally couplable to a toilet. At least one counterweight member is coupled to the back end of the toilet seat. A handle member is pivotally coupled to the counterweight member such that the upper end of the handle member upwardly extends from the counterweight member.

In these respects, the sanitary toilet seat apparatus according to the present invention substantially departs from the conventional concepts and designs of the prior art, and in so doing provides an apparatus primarily developed for the purpose of permitting a user to raise and lower a toilet seat without having to touch the toilet seat directly.

SUMMARY OF THE INVENTION

In view of the foregoing disadvantages inherent in the known types of toilet seat lifting devices now present in the prior art, the present invention provides a new sanitary toilet seat apparatus construction wherein the same can be utilized for permitting a user to raise and lower a toilet seat without having to touch the toilet seat directly.

The general purpose of the present invention, which will be described subsequently in greater detail, is to provide a new sanitary toilet seat apparatus and method which has many of the advantages of the toilet seat lifting devices mentioned heretofore and many novel features that result in a new sanitary toilet seat apparatus which is not anticipated, rendered obvious, suggested, or even implied by any of the prior art toilet seat lifting devices, either alone or in any combination thereof.

To attain this, the present invention generally comprises a toilet seat which is pivotally couplable to a toilet. At least one counterweight member is coupled to the back end of the toilet seat. A handle member is pivotally coupled to the counterweight member such that the upper end of the handle member upwardly extends from the counterweight member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new sanitary toilet seat apparatus and method which has many of the advantages of the toilet seat lifting devices mentioned heretofore and many novel features that result in a new sanitary toilet seat apparatus which is not anticipated, rendered obvious, suggested, or even implied by any of the prior art toilet seat lifting devices, either alone or in any combination thereof.

It is another object of the present invention to provide a new sanitary toilet seat apparatus which may be easily and efficiently manufactured and marketed.

It is a further object of the present invention to provide a new sanitary toilet seat apparatus which is of a durable and reliable construction.

An even further object of the present invention is to provide a new sanitary toilet seat apparatus which is susceptible of a low cost of manufacture with regard to both materials and labor, and which accordingly is then susceptible of low prices of sale to the consuming public, thereby making such sanitary toilet seat apparatus economically available to the buying public.

Still yet another object of the present invention is to provide a new sanitary toilet seat apparatus which provides in the apparatuses and methods of the prior art some of the advantages thereof, while simultaneously overcoming some of the disadvantages normally associated therewith.

Still another object of the present invention is to provide a new sanitary toilet seat apparatus for permitting a user to raise and lower a toilet seat without having to touch the toilet seat directly.

Yet another object of the present invention is to provide a new sanitary toilet seat apparatus which includes a toilet seat which is pivotally couplable to a toilet. At least one counterweight member is coupled to the back end of the toilet seat. A handle member is pivotally coupled to the counterweight member such that the upper end of the handle member upwardly extends from the counterweight member.

Still yet another object of the present invention is to provide a new sanitary toilet seat apparatus that allows easy raising and lowering of the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic back view of the present invention.

FIG. 6 is a schematic front view of the present invention.

DESCRIPTION OF THE PREFERRED EMBODIMENT

Figure 1:
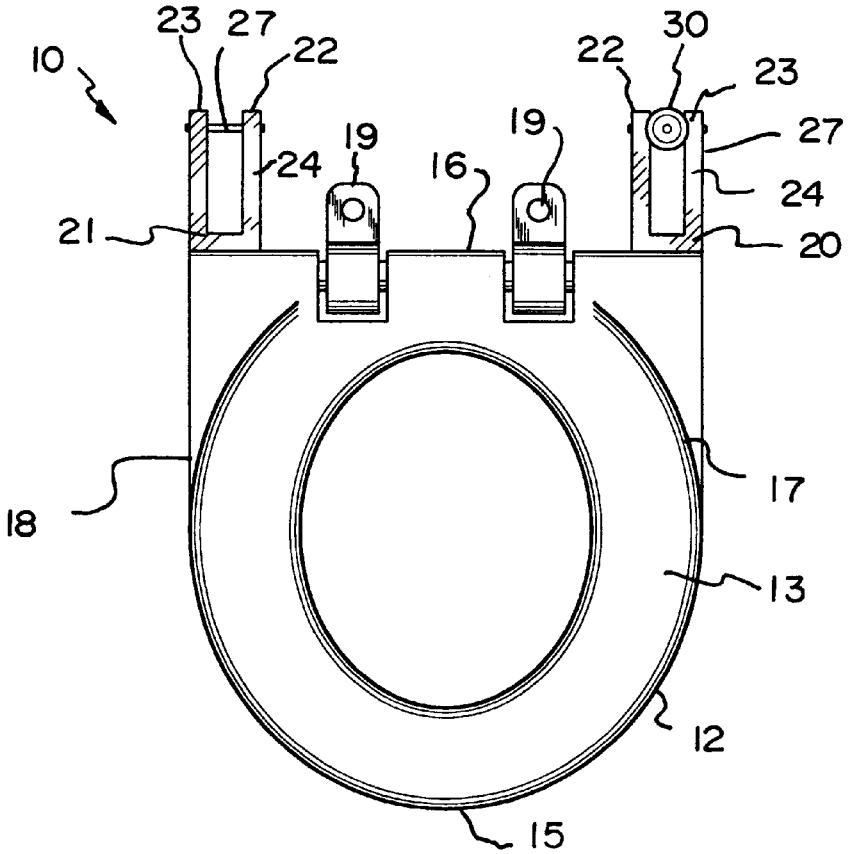
FIG. 1 is a schematic top view of a new sanitary toilet seat apparatus according to the present invention.
Figure 2:
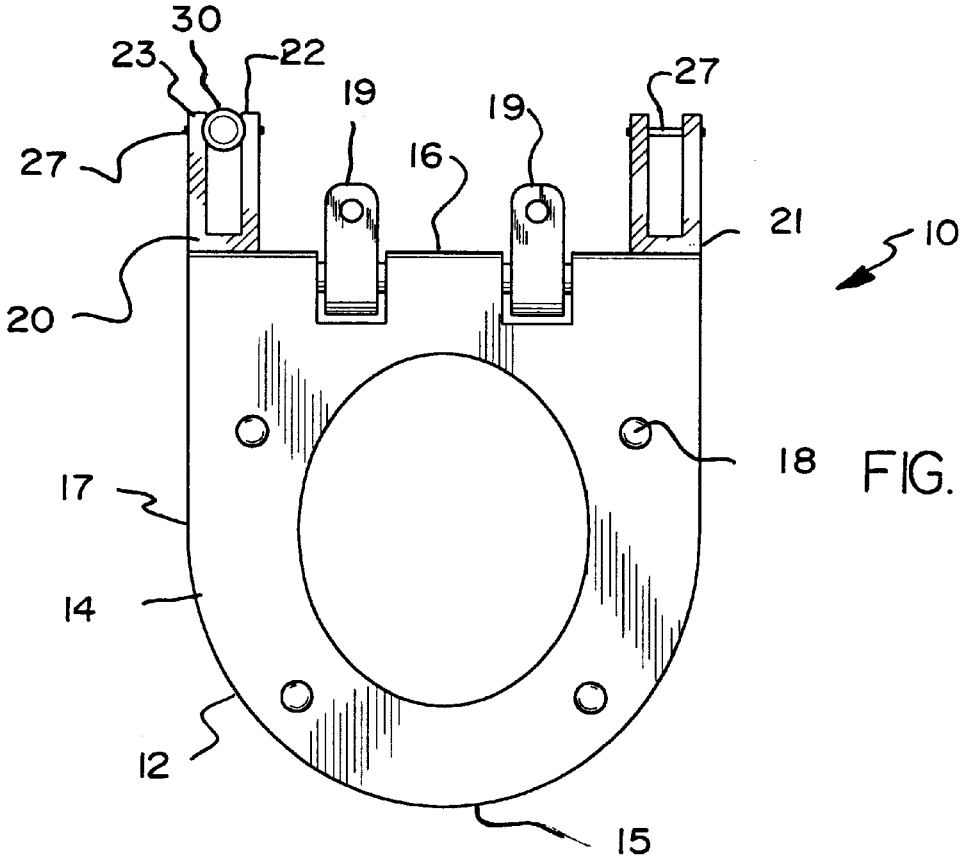
FIG. 2 is a schematic bottom view of the present invention.
Figure 3:
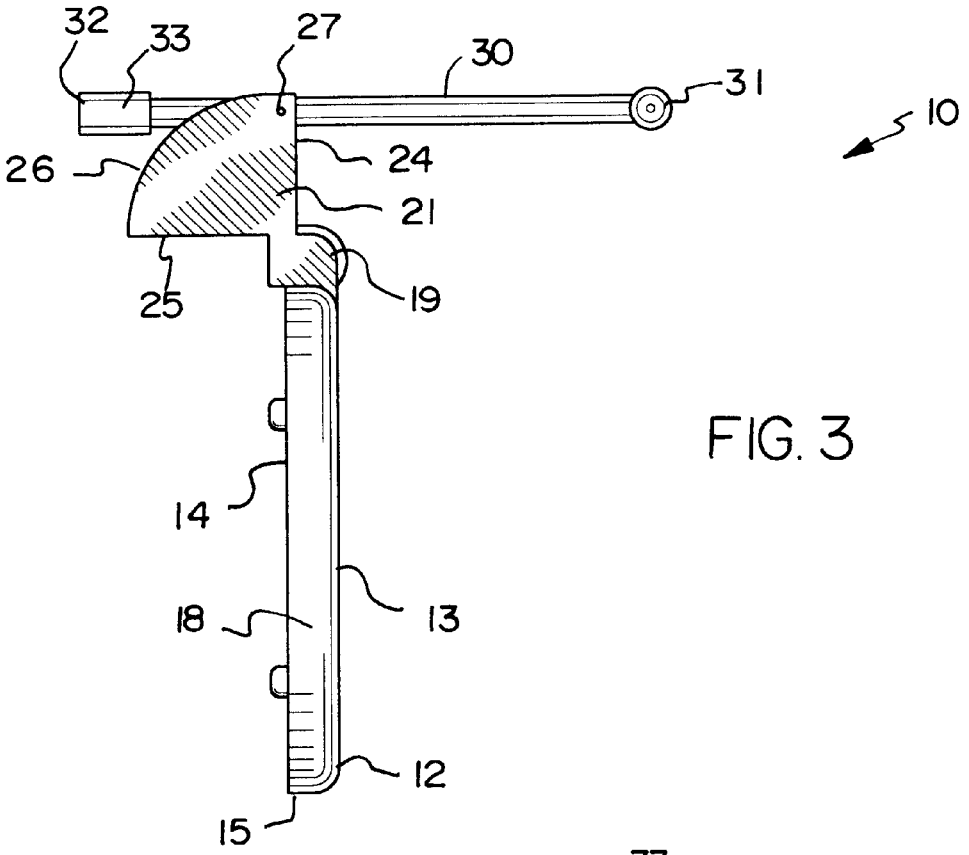
FIG. 3 is a schematic first side view of the present invention.
Figure 4:
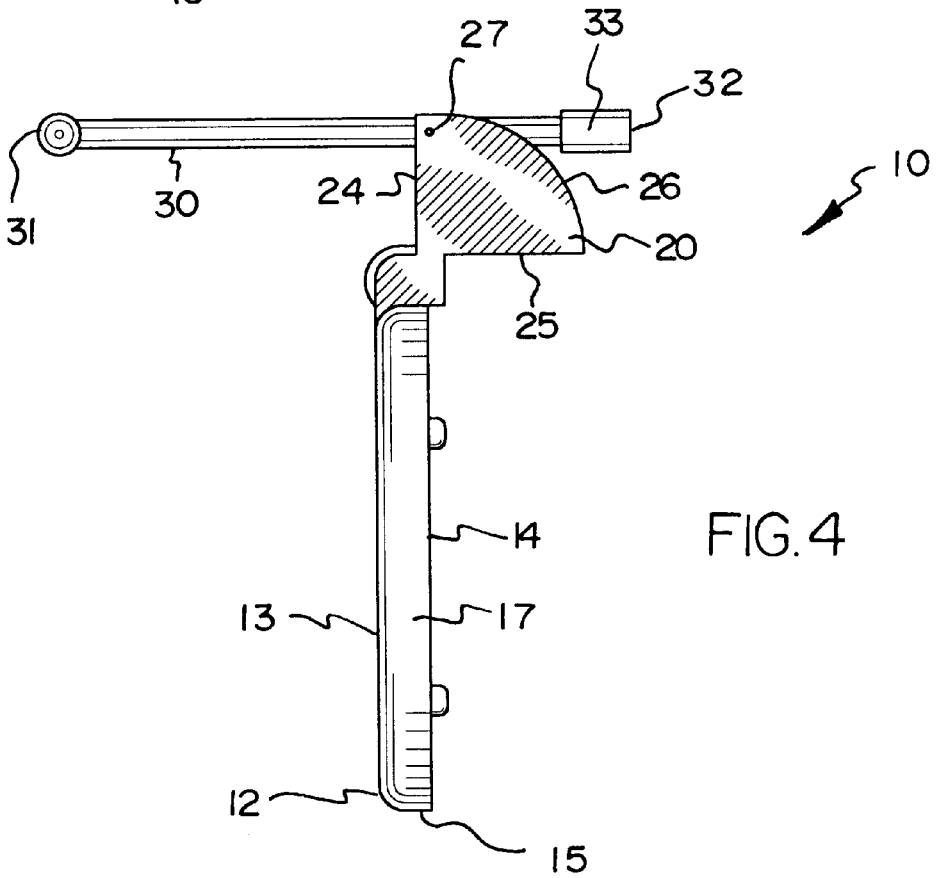
FIG. 4 is a schematic second side view of the present invention.

With reference now to the drawings, and in particular to FIGS. 1 through 8 thereof, a new sanitary toilet seat apparatus embodying the principles and concepts of the present invention and is generally designated by the reference numeral 10 will be described.

As best illustrated in FIGS. 1 through 8, the sanitary toilet seat apparatus 10 generally comprises a toilet seat 12 which is pivotally couplable to a toilet. At least one counterweight member is coupled to the back end 16 of the toilet seat 12. A handle member 30 is pivotally coupled to the counterweight member such that the upper end 31 of the handle member 30 upwardly extends from the counterweight member.

Figure 7:
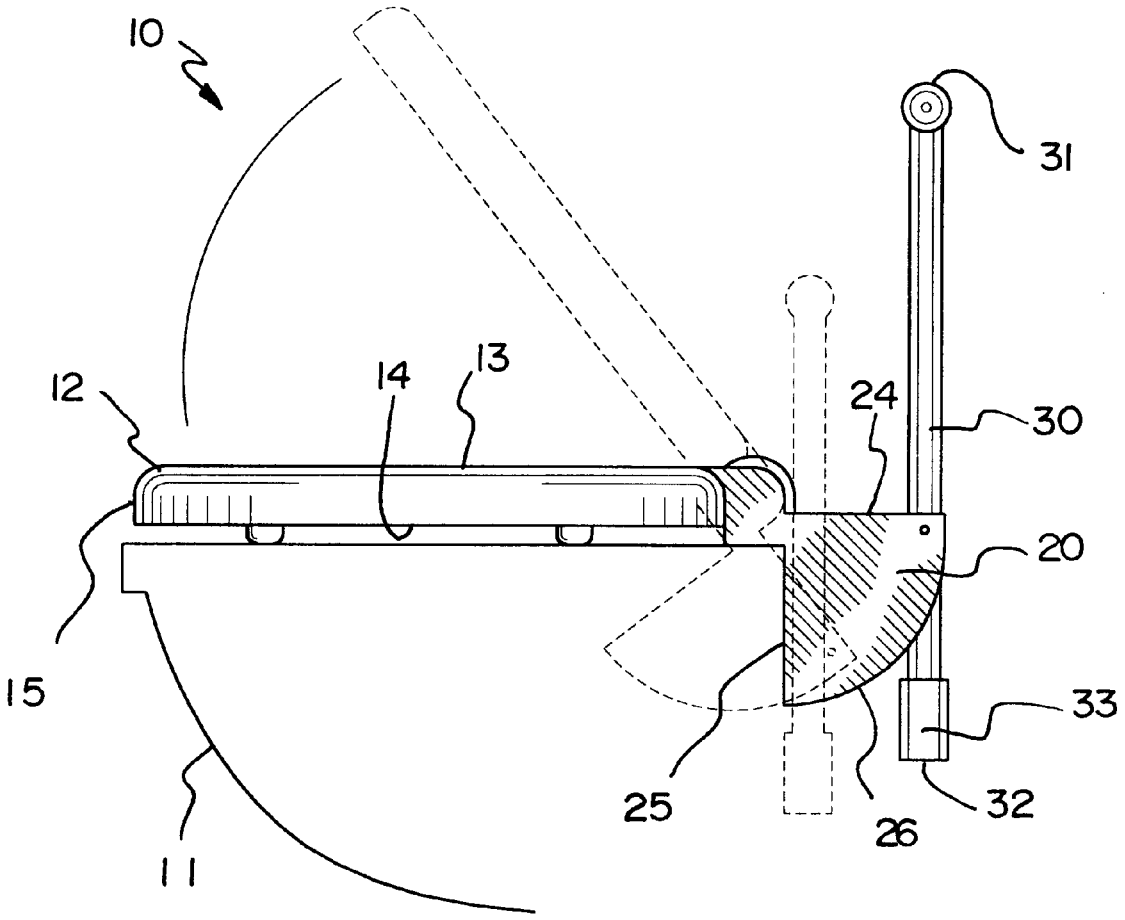
FIG. 7 is a schematic side view of the present invention illustrating the pivoting of the seat.
Figure 8:
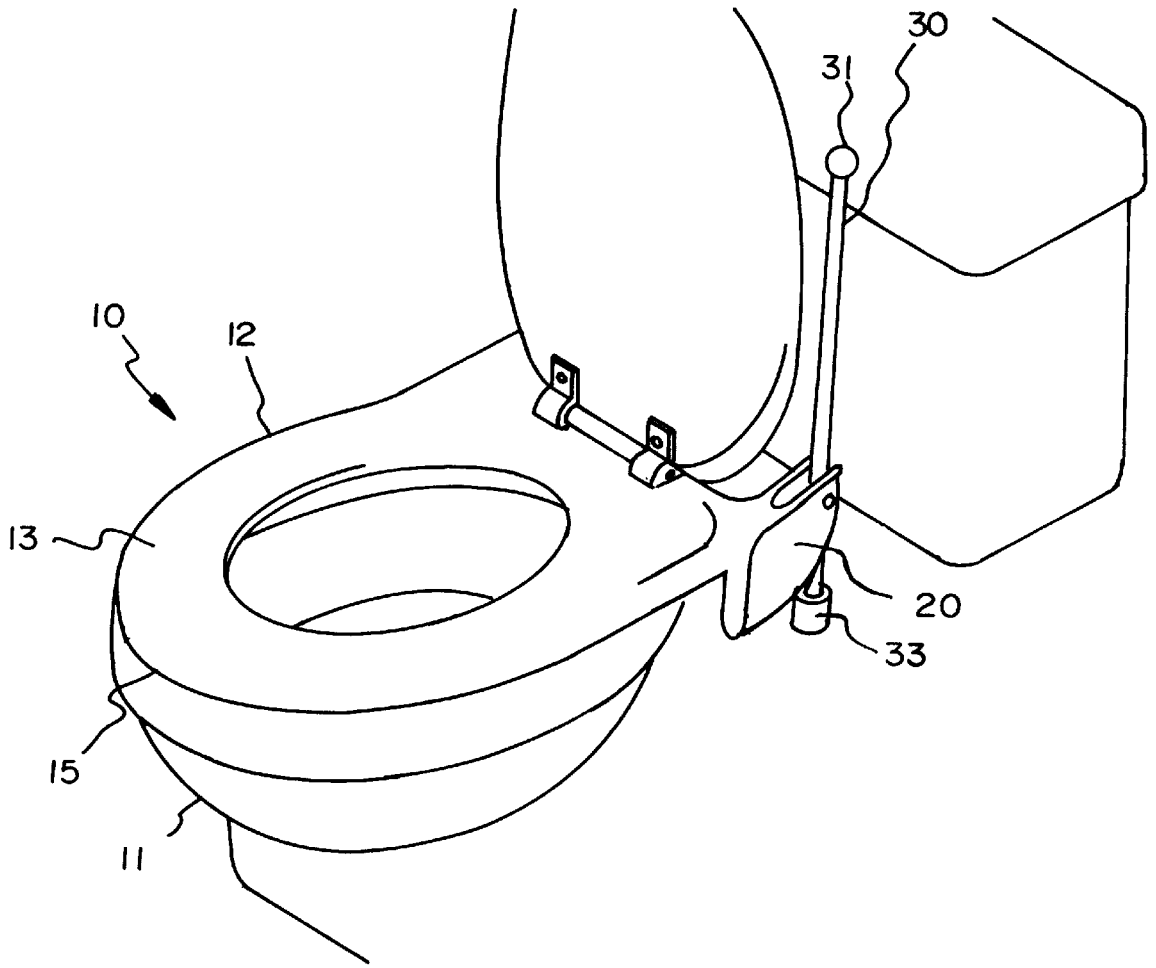
FIG. 8 is a schematic perspective view of the present invention.

In closer detail, the toilet seat 12 has top and bottom faces 13,14, front and back ends 15,16 and a pair of sides 17,18. As illustrated in FIGS. 7 and 8, the back end 16 of the toilet seat 12 is pivotally couplable with mounting brackets 19 to a toilet 11 such that the toilet seat 12 is pivotable between a lowered position and a raised position with respect to the toilet bowl of the toilet.

A pair of counterweight members 20,21 are coupled to the back end 16 of the toilet seat 12 and extend outwards away from the pivot axis of the pivot coupling between the back of the toilet seat and the toilet. Preferably, one of the counterweight members 20 is positioned towards one side 17 of the toilet seat 12 while the other counterweight member 21 is positioned adjacent the other side 18 of the toilet seat 12. The counterweight members 20,21 are designed for providing a counterweight for aiding raising and lowering of the toilet seat 12. In the preferred embodiment, each of the counterweight members 20,21 has a pair of spaced apart side portions 22,23 outwardly extending from the back end 16 of the toilet seat 12. Ideally, the side portions 22,23 of each of the counterweight members 20,21 are generally triangular with each having a top edge 24, a front edge 25 and a generally arcuate back edge 26. In this ideal embodiment, the top edges 24 of the side portions 22,23 face in a direction generally parallel to the direction the top face 13 of the toilet seat 12 faces and the front edges 25 of the side portions 22,23 face towards the direction which the front end 15 of the toilet faces. Each counterweight member has a removable pivot pin 27 extending between the side portions 22,23 of the counterweight member. Preferably, the pivot pin 27 is positioned adjacent the back edges 26 of the side portions 22,23 of the counterweight member towards the top edges 24 of the side portions 22,23 of the counterweight member.

The elongate handle member 30 has opposite upper and lower ends 31,32, and a longitudinal axis extending between the upper and lower ends 31,32 of the handle member 30. The handle member 30 may be pivotally coupled to either of the counterweight members depending on the preference of the user. In particular, the handle member 30 is interposed between the side portions 22,23 of the particular counterweight member 20 it is pivotally coupled to. The handle member 30 has a pivot bore extending therethrough. The pivot bore of the handle member 30 is preferably positioned between the upper and lower ends 31,32 of the handle member 30 and is generally perpendicular to the longitudinal axis of the handle member 30. The pivot pin 27 of the one counterweight member 20 is extended through the pivot bore of the handle member 30 such that the handle member 30 is pivotally coupled to that counterweight member so that the upper end 31 of the handle member 30 extends upwardly from the counterweight member and the lower end 32 of the handle member 30 downwardly depends from the counterweight member.

Preferably, the lower end 32 of the handle member 30 has a secondary counterweight portion 33. The secondary counterweight portion 33 is designed for aiding the maintaining of the longitudinal axis of the handle member 30 in a vertical plane when the toilet seat 12 is pivoted between the raised and lowered positions so that the upper end of the handle member is easily reached by a user.

In use, a user uses the upper end of the handle member to both raise and lower the toilet seat from the toilet bowl. When pivoting the toilet seat from the lowered position towards the raised position, the user pushes downwards on the handle. Conversely, when pivoting the toilet seat from the raised position towards the lowered position, the user pulls upwards on the handle member.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sanitary toilet seat apparatus for a toilet, said apparatus comprising:

a toilet seat having top and bottom faces, front and back ends and a pair of sides;

said back end of said toilet seat being pivotally couplable to said toilet such that said toilet seat is pivotable about a first axis between a lowered position and a raised position with respect to the toilet bowl of the toilet;

at least one counterweight member being coupled to said back end of said toilet seat in proximity to said first axis;

an elongate handle member having opposite upper and lower ends, and a longitudinal axis extending between said upper and lower ends of said handle member, a secondary counterweight member mounted on said lower end; and said handle member being pivotally coupled to said counterweight member at an intermediate point thereof about a second axis parallel to said first axis such that said upper end of said handle member pivots in a first direction about said second axis as said secondary; counterweight member pivots in the opposite direction about said second axis.

2. The apparatus of claim 1, wherein said counterweight member is positioned towards one of said sides of said toilet seat.

3. The apparatus of claim 1, wherein said counterweight member has a pair of spaced apart side portions outwardly extending from said back end of said toilet seat, and wherein said handle member is interposed between said side portions of said counterweight member.

4. The apparatus of claim 3, wherein said counterweight member has a pivot pin extending between said side portions of said counterweight member, wherein said handle member has a pivot bore extending therethrough, and wherein said pivot pin of said one counterweight member is extended through said pivot bore of said handle member such that said handle member is pivotally coupled to said one counterweight member.

5. The apparatus of claim 4, wherein said pivot bore of said handle member is positioned between said upper and lower ends of said handle member and said pivot bore of said handle member is generally perpendicular to said longitudinal axis of said handle member.

6. The apparatus of claim 4, wherein each of said side portions is generally triangular and having a top edge, a front edge and a generally arcuate back edge, wherein said pivot pin is positioned adjacent said back edges of said side portions of said counterweight member towards said top edges of said side portions of said counterweight member.

7. A sanitary toilet seat apparatus for a toilet, said apparatus comprising:

a toilet seat having top and bottom faces, front and back ends and a pair of sides;

said back end of said toilet seat being pivotally couplable to said toilet such that said toilet seat is pivotable between a lowered position and a raised position with respect to the toilet bowl of the toilet;

a pair of counterweight members being coupled to said back end of said toilet seat, one of said counterweight members being positioned towards one of said sides of said toilet seat, another of said counterweight members being positioned adjacent the other of said sides of said toilet seat;

each of said counterweight members having a pair of spaced apart side portions outwardly extending from said back end of said toilet seat;

each of said side portions of each of said counterweight members being generally triangular and having a top edge, a front edge and a generally arcuate back edge;

said top edges of said side portions facing towards said top face of said toilet seat, said front edges of said side portions facing towards said front end of said toilet;

said each counterweight member having a pivot pin extending between said side portions of said counterweight member, said pivot pin being positioned adjacent said back edges of said side portions of said counterweight member towards said top edges of said side portions of said counterweight member;

an elongate handle member having opposite upper and lower ends, and a longitudinal axis extending between said upper and lower ends of said handle member;

said handle member being interposed between said side portions of one of said counterweight members;

said handle member having a pivot bore extending therethrough, said pivot bore of said handle member being positioned between said upper and lower ends of said handle member, said pivot bore of said handle member being generally perpendicular to said longitudinal axis of said handle member;

said pivot pin of said one counterweight member being extended through said pivot bore of said handle member such that said handle member is pivotally coupled to said one counterweight member so that the upper end of said handle member extends upwardly from the counterweight member and the lower end of the handle member downwardly depends from the counterweight member; and said lower end of said handle member having a secondary counterweight portion.

* * * * *